US009260809B2

(12) United States Patent
McClintock et al.

(10) Patent No.: US 9,260,809 B2
(45) Date of Patent: Feb. 16, 2016

(54) MATTRESS COVER CLOSING MACHINE AND METHOD

(71) Applicant: L&P Property Management Company, South Gate, CA (US)

(72) Inventors: Kyle W. McClintock, Jasper, MO (US); Dustin W. Smith, Cathage, MO (US); Jay Mark Smith, Carthage, MO (US)

(73) Assignee: L&P Property Management Company, South Gate, CA (US)

( * ) Notice: Subject to any disclaimer, the term of this patent is extended or adjusted under 35 U.S.C. 154(b) by 309 days.

(21) Appl. No.: 14/019,043

(22) Filed: Sep. 5, 2013

(65) Prior Publication Data

US 2015/0059633 A1 Mar. 5, 2015

(51) Int. Cl.
*D05B 11/00* (2006.01)

(52) U.S. Cl.
CPC ..... *D05B 11/005* (2013.01)

(58) Field of Classification Search
CPC ..... D05B 11/005; D05B 11/00
See application file for complete search history.

(56) References Cited

U.S. PATENT DOCUMENTS

| | | | | | |
|---|---|---|---|---|---|
| 1,322,842 | A | | 11/1919 | Sutton | |
| 2,185,251 | A | | 1/1940 | Goldberg | |
| 2,609,768 | A | | 9/1952 | Cash et al. | |
| 2,918,884 | A | * | 12/1959 | Kalning | D05B 11/005 112/2.1 |
| 2,925,057 | A | * | 2/1960 | Cash, Sr. | B68G 7/10 112/2.1 |
| 3,062,160 | A | * | 11/1962 | Cash, Sr. | D05B 11/005 112/2.1 |
| 3,641,954 | A | | 2/1972 | Kalning et al. | |
| 3,664,280 | A | * | 5/1972 | Redman | D05B 11/005 112/2.1 |
| 4,014,273 | A | | 3/1977 | Kosakai | |
| 4,014,274 | A | | 3/1977 | Kosakai | |
| 4,155,317 | A | | 5/1979 | Enomoto | |
| 4,905,615 | A | * | 3/1990 | Pofferi | B68G 7/10 112/129 |
| 5,515,796 | A | * | 5/1996 | Ogle | D05B 11/005 112/2.1 |
| 5,526,761 | A | * | 6/1996 | Mulcahey | D05B 27/04 112/314 |
| 6,408,773 | B2 | * | 6/2002 | Resta | D05B 11/005 112/122 |
| 6,994,043 | B1 | | 2/2006 | Price | |
| 7,181,794 | B2 | | 2/2007 | Diaz | |
| 7,484,256 | B2 | | 2/2009 | Murphy et al. | |
| 7,597,059 | B2 | | 10/2009 | Stutznacker | |
| 7,647,876 | B2 | | 1/2010 | Oxley et al. | |
| 7,971,542 | B2 | | 7/2011 | Block et al. | |
| 7,984,681 | B1 | | 7/2011 | Oxley et al. | |
| 8,042,478 | B2 | | 10/2011 | Oxley et al. | |
| 2008/0229715 | A1 | | 9/2008 | Schmidt et al. | |
| 2009/0064911 | A1 | | 3/2009 | Oxley et al. | |
| 2015/0059633 | A1 | * | 3/2015 | McClintock | D05B 11/005 112/475.08 |

* cited by examiner

*Primary Examiner* — Danny Worrell
(74) *Attorney, Agent, or Firm* — Wood, Herron & Evans, LLP

(57) ABSTRACT

A machine for closing an open end of a cover encasing a mattress core in order to form a mattress is provided. A frame is adapted to support at least an edge portion of the mattress core encased in the cover. A mattress core press is mounted on the frame for vertical movement and is adapted to compress an edge of the mattress core to a desired height. A mattress cover clamp is mounted on the frame for vertical movement and is adapted to clamp free edges of the open end of the mattress cover together. A sewing head carriage is mounted on the frame for horizontal movement. A sewing head is mounted on the carriage, and a sewing head motor is mounted on the carriage for driving the sewing head. The sewing head is adapted to stitch the free edges of the open end of the mattress cover closed as the sewing head carriage traverses from one side of the mattress to the other side of the mattress.

16 Claims, 11 Drawing Sheets

MATTRESS COVER CLOSING MACHINE AND METHOD

RELATED APPLICATIONS

N/A

FIELD OF THE INVENTION

This invention relates generally to bedding, and more particularly to machines for stitching mattress covers closed.

BACKGROUND OF THE INVENTION

In the manufacture of mattresses, it is known to encase the mattress core in a cover or "sock." The cover or sock may be fabricated of a fire retardant material. Once the mattress core is placed in the cover, it is necessary to stitch the open end of the cover closed.

A secure seam is important to the fire retardancy of the finished mattress. A tight fit of the cover to the core is also desirable. Further, it is desirable to automate the process of closing the mattress cover to the extent possible.

Accordingly, a improved mattress cover closing machine that attains these goals is desirable.

SUMMARY OF THE INVENTION

In one aspect, a machine for closing an open end of a cover encasing a mattress core in order to form a mattress is provided. The machine comprises a frame adapted to support at least an edge portion of the mattress core encased in the cover. A mattress core press is mounted on the frame for vertical movement and is adapted to compress an edge of the mattress core to a desired height. A mattress cover clamp is mounted on the frame for vertical movement and is adapted to clamp free edges of the open end of the mattress cover together. A sewing head carriage is mounted on the frame for horizontal movement. A sewing head is mounted on the carriage, and a sewing head motor is mounted on the carriage for driving the sewing head. The sewing head is adapted to stitch the free edges of the open end of the mattress cover closed as the sewing head carriage traverses from one side of the mattress to the other side of the mattress.

The machine can further comprise a sewing head carriage motor mounted on the frame for driving the carriage from one side of the mattress to the other side of the mattress. The machine can be configured such that the speed of the sewing head motor and the speed of the sewing head carriage motor can each be selected from a range of speeds in order to produce a desired number of stitches per unit length of the machine. The machine can further comprise a processor controller operably associated with the sewing head motor and the sewing head carriage motor, and an operator interface operably associated with the processor controller. The processor controller and the operator interface are configured such that an operator can enter a selected speed for each of the sewing head motor and the sewing head carriage motor via the operator interface and the processor controller will operate the sewing head motor and the sewing head carriage motor at the selected speeds.

The mattress core press can comprise a platen having a pair of opposite ends. Each end of the platen can be operably connected to the frame by a pneumatic cylinder. The platen can cooperate with a press base mounted on the frame. Each end of the platen can carry a gear rack. Each gear rack can mesh with a respective gear rotatably mounted on the frame.

The two gears can be interconnected with a connecting rod. The platen can thereby be raised and lowered with the opposite ends of the platen traveling upperwardly and downwardly in synchronous movement. The frame can have a pair of adjustable height stops mounted thereto each of which is configured to cooperate with a respective end of the platen. A height from an upper surface of the press base to a lower surface of the platen can be selected from a range of heights thereby determining the amount of compression of the mattress core.

The mattress cover clamp can comprise an upper vertically oriented plate having a pair of opposite ends. Each end of the upper vertically oriented plate can be operably connected to the frame by a pneumatic cylinder. The upper vertically oriented plate can cooperate with a lower vertically oriented plate mounted on the frame. Each end of the upper vertically oriented plate can carry a gear rack. Each gear rack can mesh with a respective gear rotatably mounted on the frame. The two gears can be interconnected with a connecting rod. The upper vertically oriented plate can thereby be raised and lowered with the opposite ends of the upper vertically oriented plate traveling upperwardly and downwardly in synchronous movement.

The sewing head can have a blade mounted thereto adapted to trim off excess cover material as the sewing head carriage traverses from one side of the mattress to the other side of the mattress.

The sewing head carriage motor can be operably connected to an elongated screw rotatably mounted on the frame. The elongated screw can cooperate with a threaded block mounted on the sewing head carriage. Rotation of the screw by the sewing head carriage motor drives the sewing head carriage from one side of the mattress to the other side of the mattress.

In another aspect, a method of closing an open end of a cover encasing a mattress core in order to form a mattress is provided. The method comprises compressing an edge of the mattress core to a desired height with a mattress core press, clamping free edges of the open end of the mattress cover together with a mattress cover clamp, and stitching the free edges of the open end of the mattress cover closed with a sewing head mounted on a sewing head carriage that traverses from one side of the mattress to the other side of the mattress.

The sewing head can have a sewing head motor for driving the sewing head and the sewing head carriage can have a sewing head carriage motor for driving the sewing head carriage. The method can then further comprise selecting a speed of the sewing head motor from a range of speeds, and selecting a speed of the sewing head carriage motor from a range of speeds, such that the selected speeds produce a desired number of stitches per unit length. The steps of selecting the speed of the sewing head motor and the speed of the sewing head carriage motor can be accomplished by entering the selected speeds into an operator interface operably associated with a processor controller, the processor controller operably associated with the sewing head motor and the sewing head carriage motor and configured to operate the sewing head motor and sewing head carriage motor at the selected speeds. The processor controller can also be operably associated with the mattress core press and the mattress cover clamp. The compressing and clamping steps can be accomplished by entering commands into the operator interface.

In another aspect, another method of closing an open end of a cover encasing a mattress core in order to form a mattress is provided. This method comprises compressing an edge of the mattress core to a desired height with a mattress core press, clamping free edges of the open end of the mattress cover together with a mattress cover clamp, selecting a desired number of stitches per unit length by which to stitch closed the open end of the cover, selecting a sewing head stitching speed at which to stitch closed the open end of the cover, selecting a sewing head travel speed by which to traverse from one side of the mattress to the other side of the mattress, the sewing head stitching speed and the sewing head travel speed cooperating to produce the selected number of stitches per unit length, and activating the sewing head to stitch closed the open end of the cover and to traverse from one side of the mattress to the other side of the mattress.

The steps of selecting the sewing head stitching speed and the sewing head travel speed can be accomplished by entering the selected speeds into an operator interface operably associated with a processor controller, the processor controller operably associated with the sewing head and configured to operate the sewing head at the selected speeds. The processor controller can also be operably associated with the mattress core press and the mattress cover clamp. The compressing and clamping steps can be accomplished by entering commands into the operator interface.

In another aspect, another machine for closing an open end of a cover encasing a mattress core in order to form a mattress is provided. The machine comprises a frame adapted to support at least an edge portion of the mattress core encased in the cover. A sewing head carriage is movably mounted on the frame. A sewing head carriage motor is mounted on the frame for driving the carriage from one side of the mattress to the other side of the mattress. A sewing head is mounted on the carriage. A sewing head motor is mounted on the carriage for driving the sewing head. The sewing head is adapted to stitch free edges of an open end of the mattress cover closed as the sewing head carriage traverses from one side of the mattress to the other side of the mattress. A processor controller is operably associated with the sewing head motor and the sewing head carriage motor. An operator interface is operably associated with the processor controller. The processor controller and the operator interface are configured such that an operator can enter a selected speed for each of the sewing head motor and the sewing head carriage motor via the operator interface and the processor controller will operate the sewing head motor and the sewing head carriage motor at the selected speeds.

The machine can further comprise a mattress core press mounted on the frame for vertical movement and adapted to compress the edge of the mattress core to a desired height, and a mattress cover clamp mounted on the frame for vertical movement and adapted to clamp the free edges of the open end of the mattress cover together. The processor controller and the operator interface are further configured such that an operator can activate and deactivate the mattress core press and the mattress cover clamp by entering commands into the operator interface.

The accompanying drawings, which are incorporated in and constitute a part of this specification, illustrate embodiments of the invention and, together with the summary of the invention given above, and the detailed description of the drawings given below, serve to explain the principles of the present invention.

DETAILED DESCRIPTION OF THE INVENTION

Figure 1:
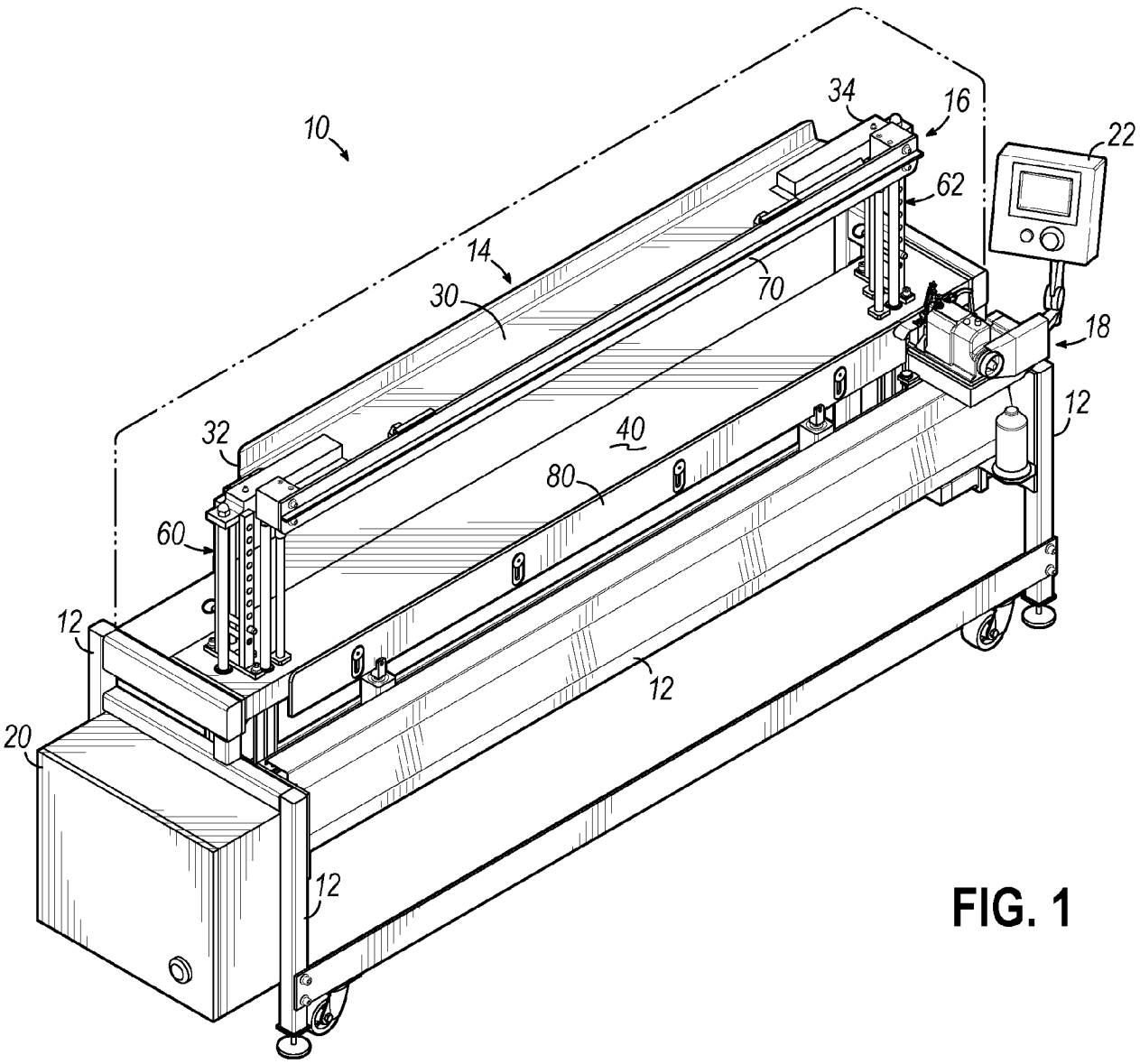
FIG. 1 is a perspective view of the mattress cover closing machine of the present invention.
Figure 1A:
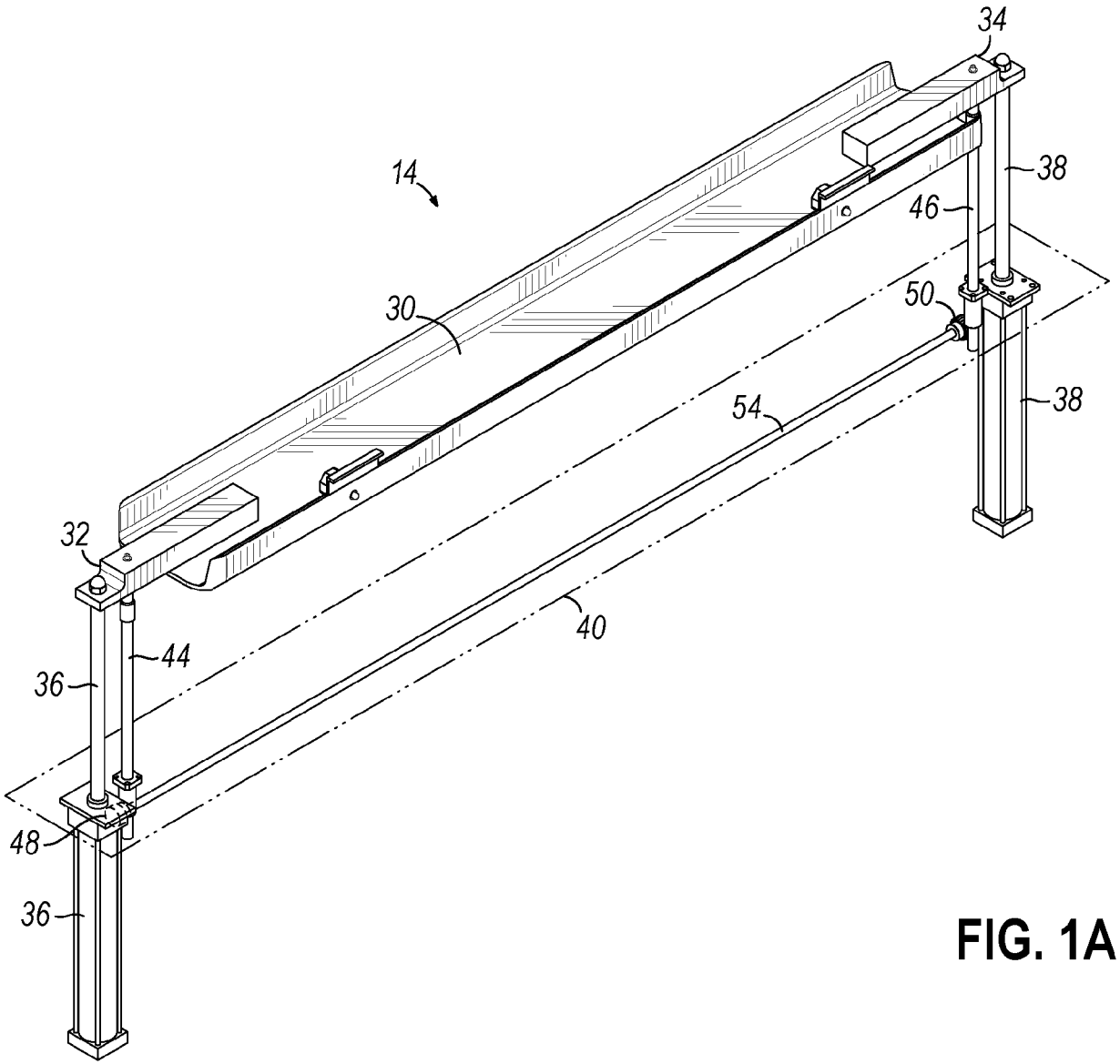
FIG. 1A is a perspective view of the mattress core press of the machine of FIG.
Figure 1B:
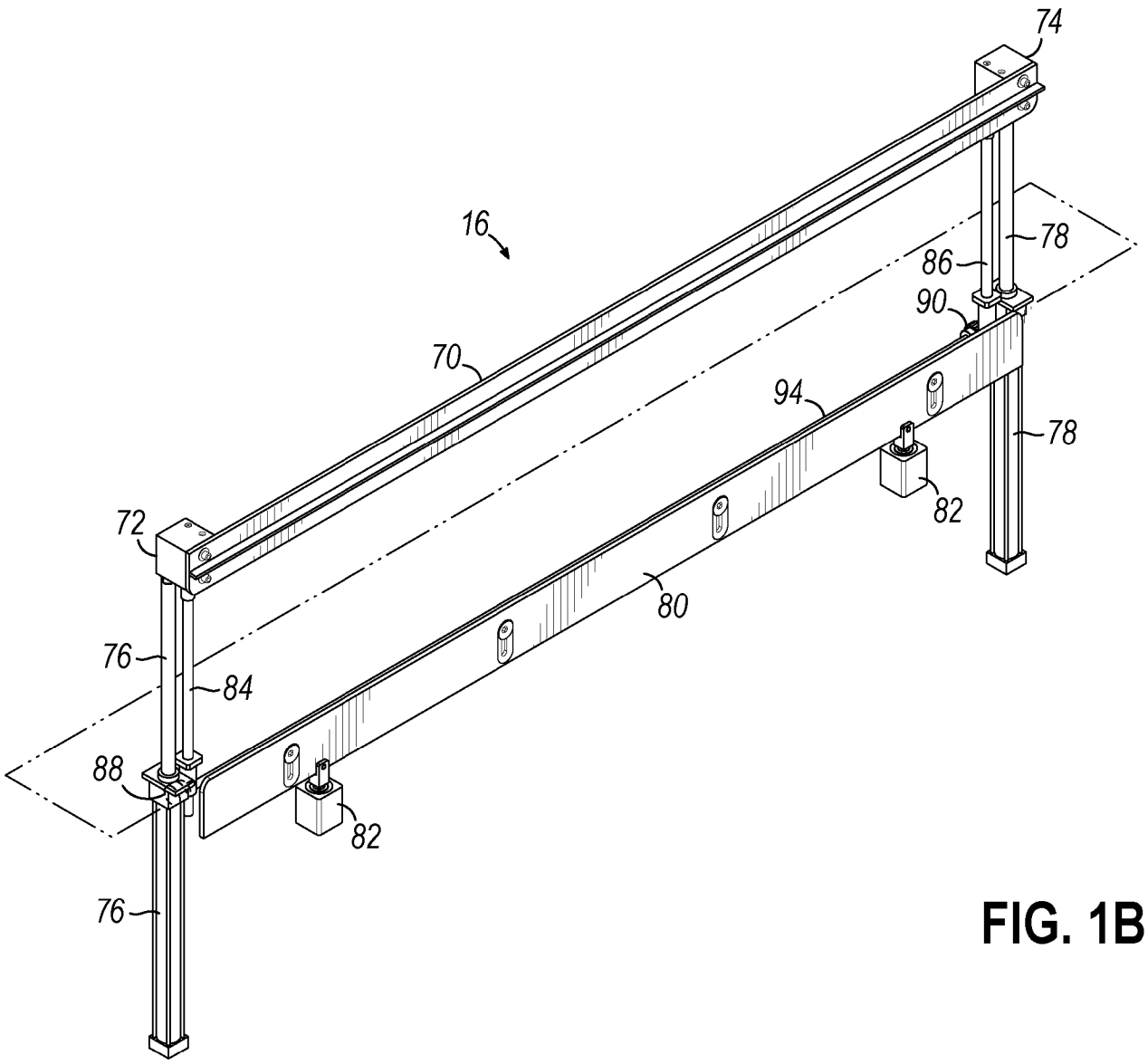
FIG. 1B is a perspective view of the mattress cover clamp of the machine of FIG. 1.
Figure 2:
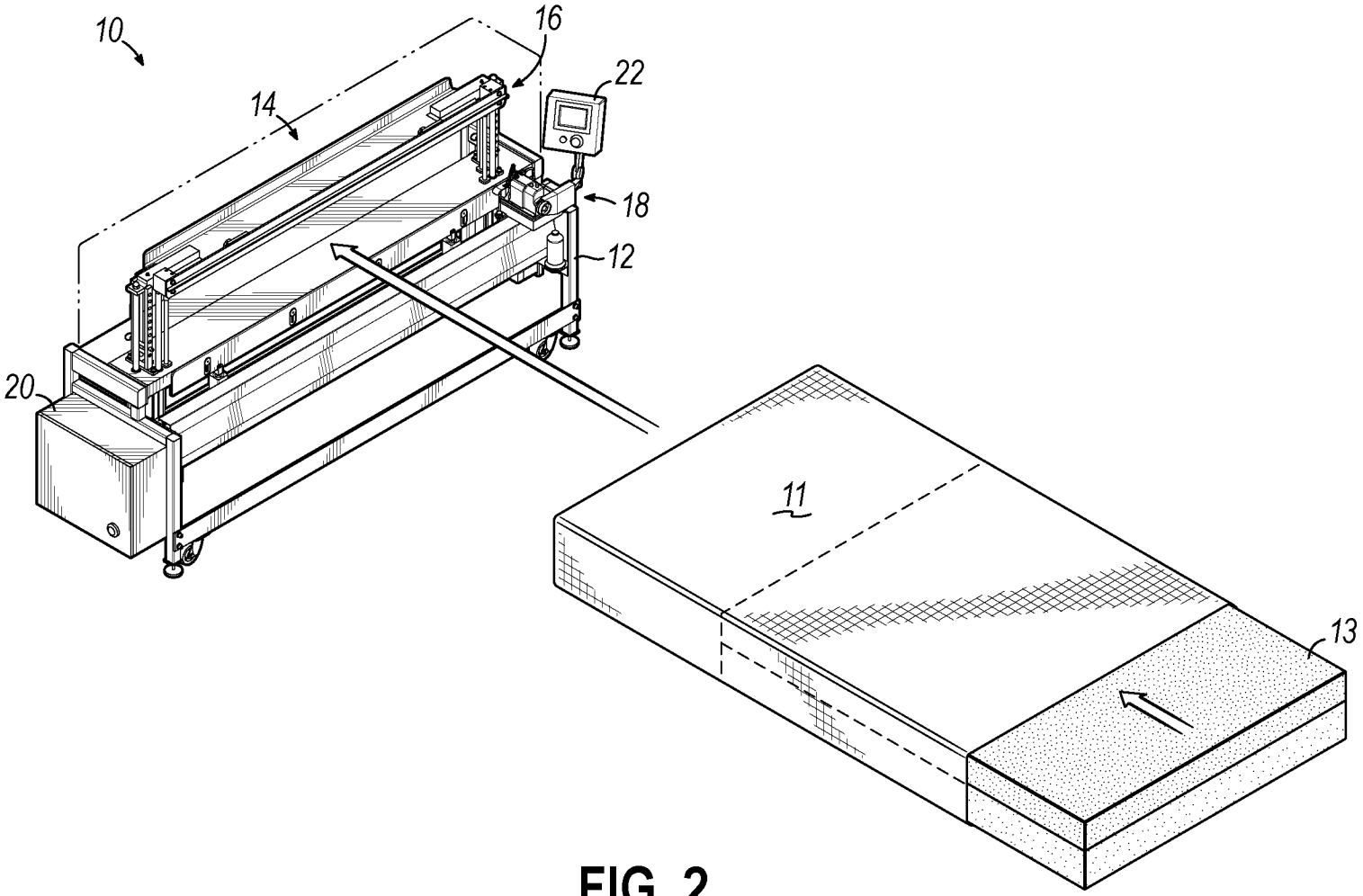
FIG. 2 is a perspective view of a mattress core being inserted into a mattress cover and then being inserted into the machine of FIG. 1.

Referring first to FIGS. 1 and 2, there is illustrated a machine 10 for closing an open end of a cover 11 encasing a mattress core 13 in order to form a mattress. The machine 10 comprises a frame 12, a mattress core press assembly 14, a mattress cover clamp assembly 16, a sewing head assembly 18, a processor controller 20, and an operator interface 22.

Figure 3:
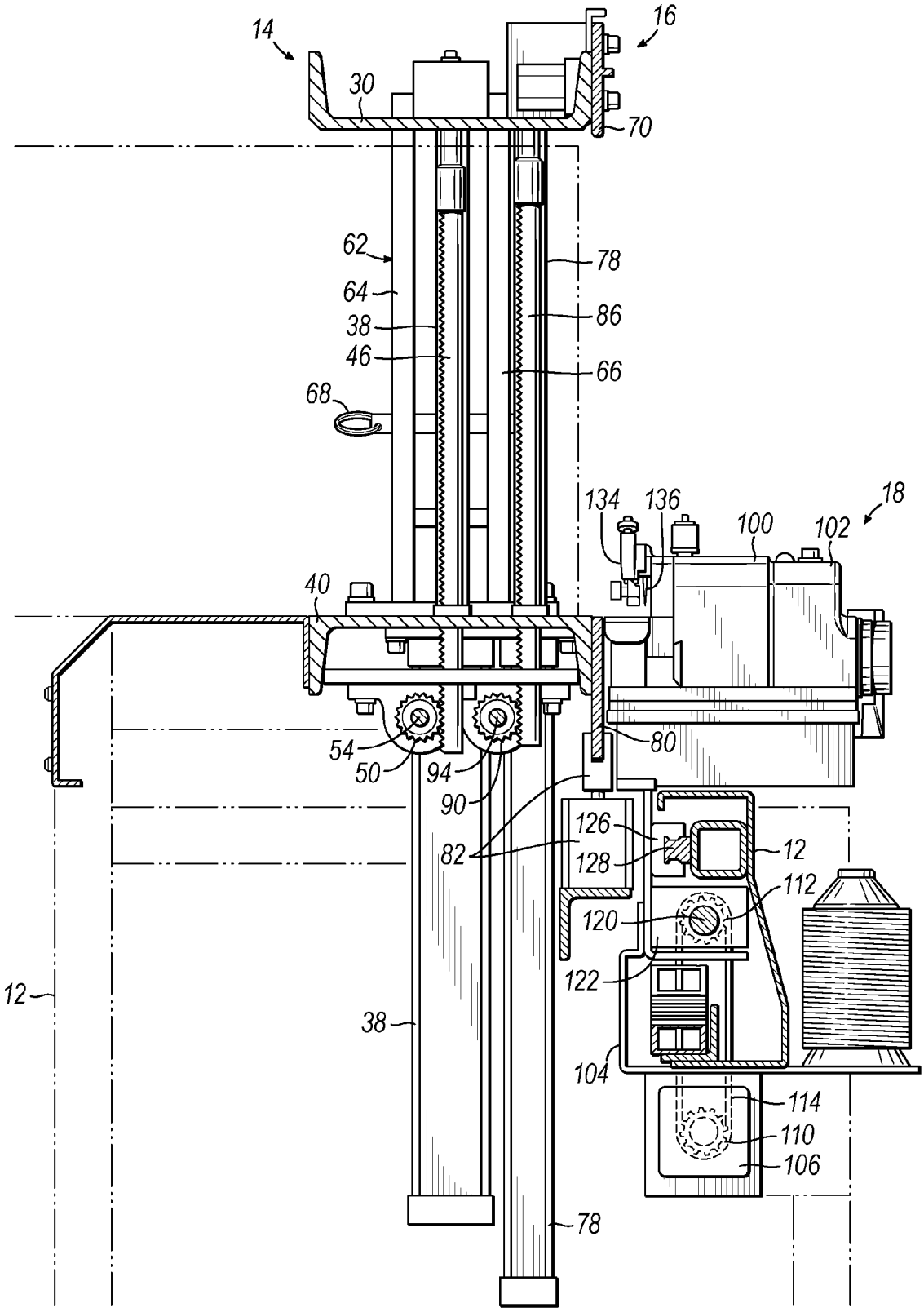
FIG. 3 is a cross-sectional view of the machine of FIG. 1.
Figure 4A:
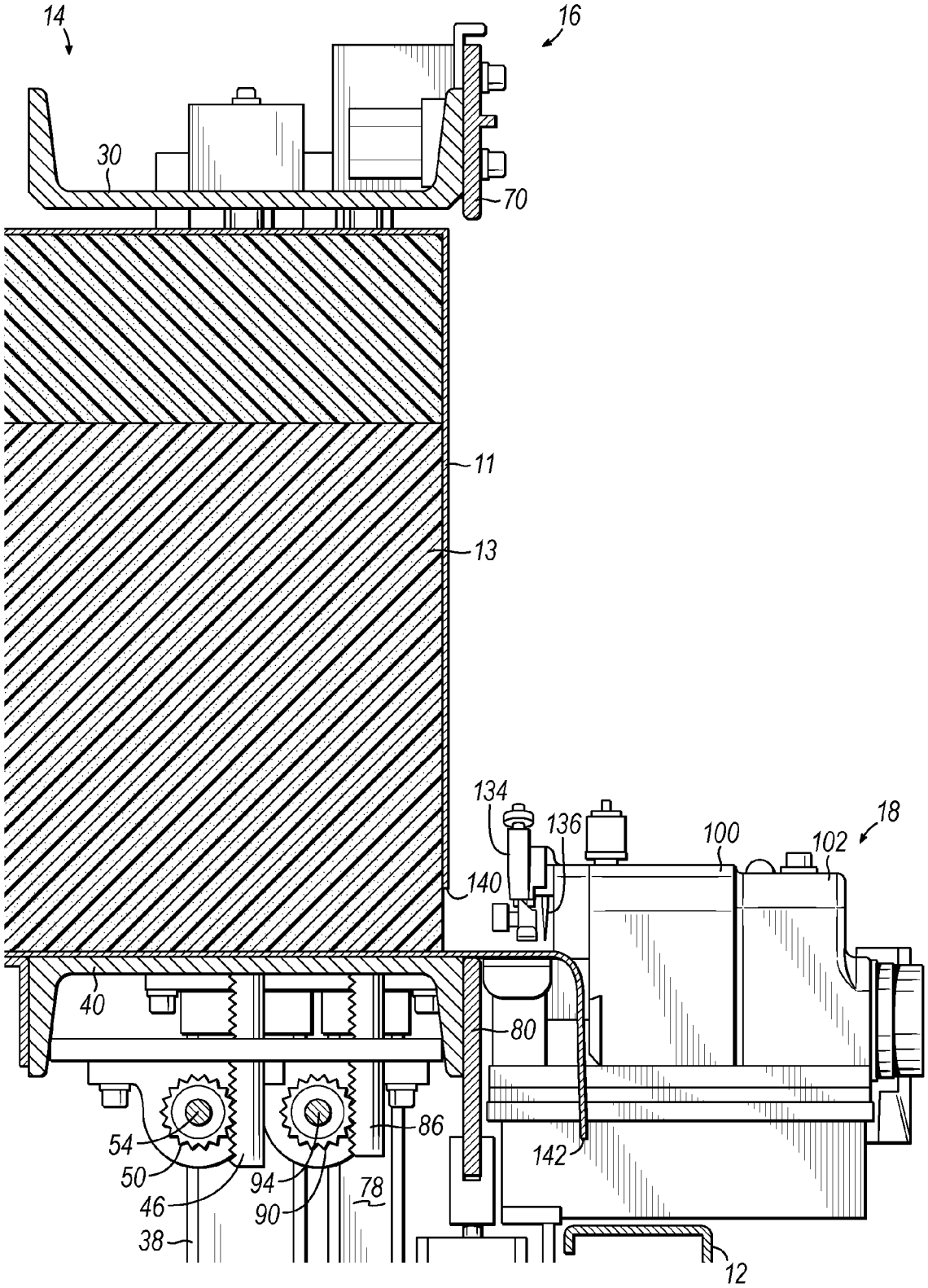
FIG. 4A is a view similar to FIG. 3 with the mattress inserted into the machine.
Figure 4B:
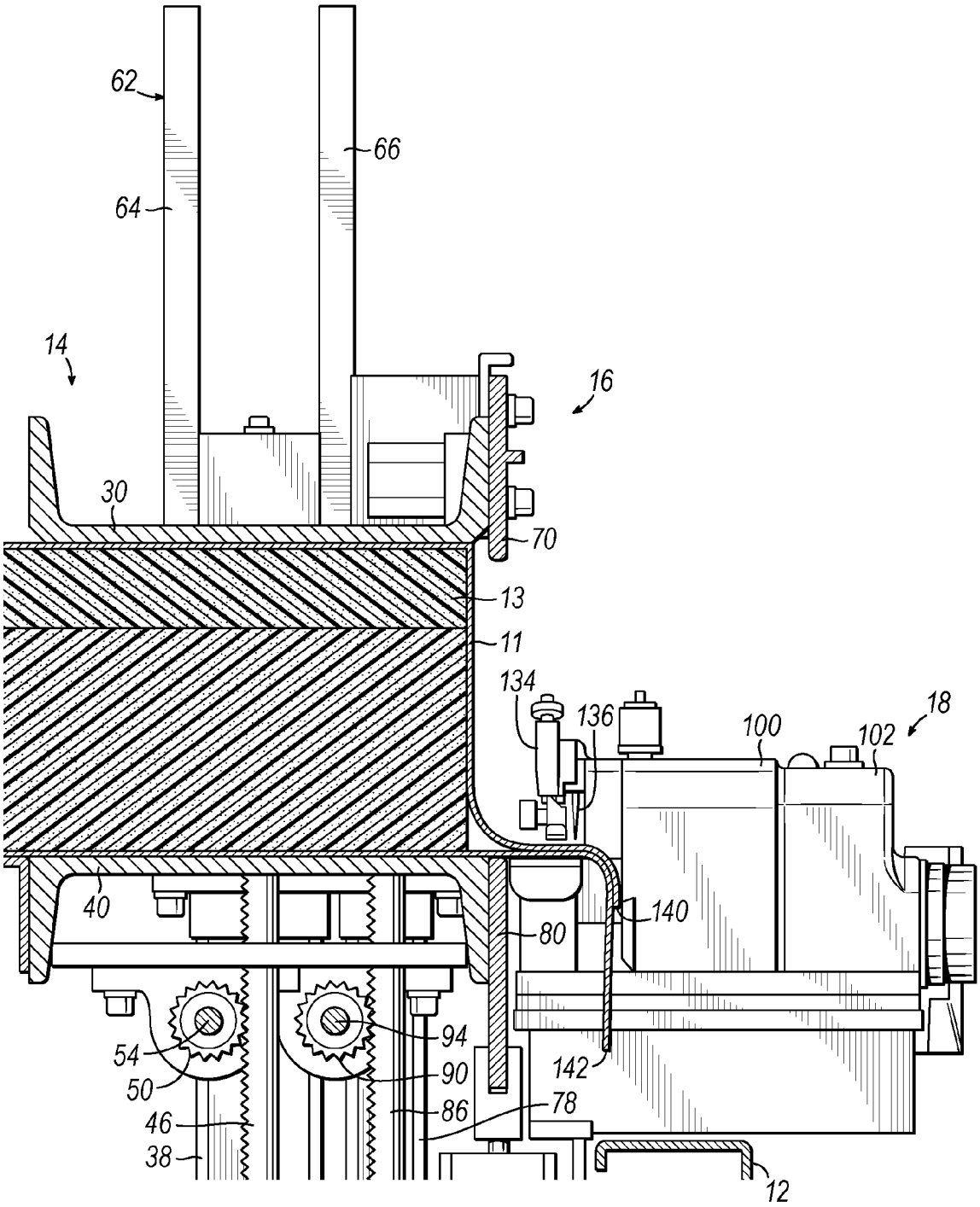
FIG. 4B is a view similar to FIG. 4A with the edge of the mattress core being compressed by the mattress core press.
Figure 4C:
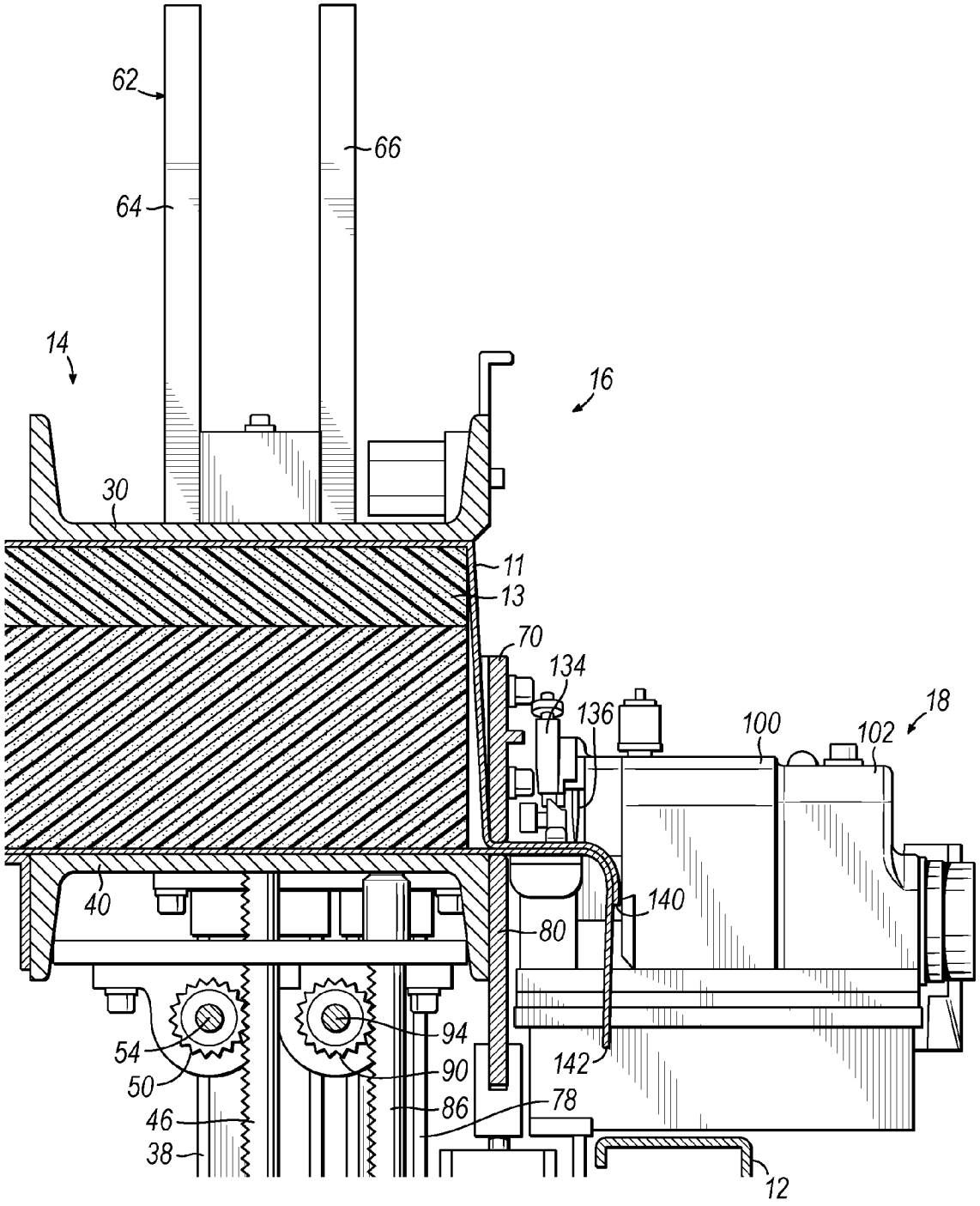
FIG. 4C is a view similar to FIG. 4B with the edge of the mattress cover being clamped by the mattress cover clamp.
Figure 4D:
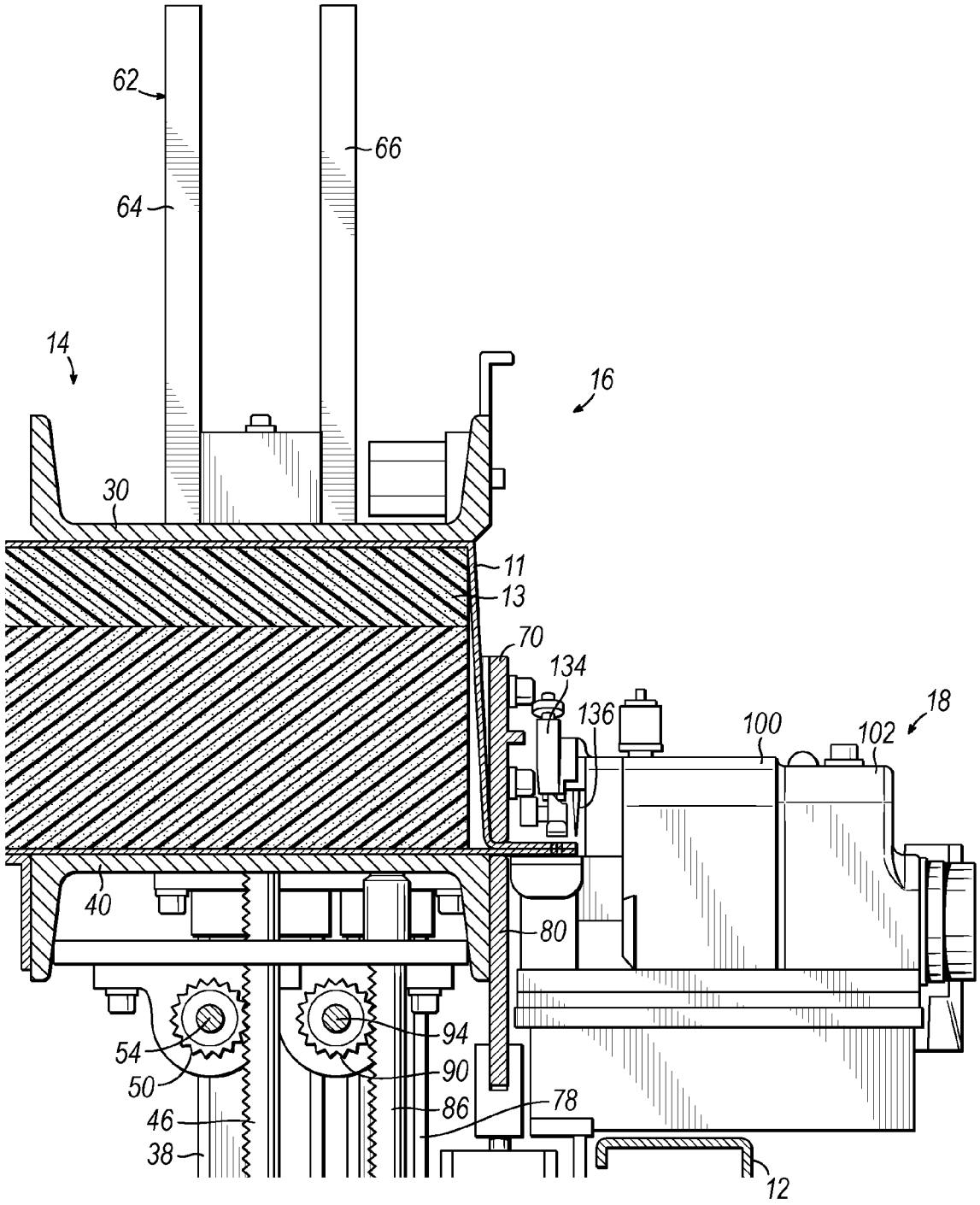
FIG. 4D is a view similar to FIG. 4C with the free edges of the mattress cover being stitched closed by the sewing head.
Figure 4E:
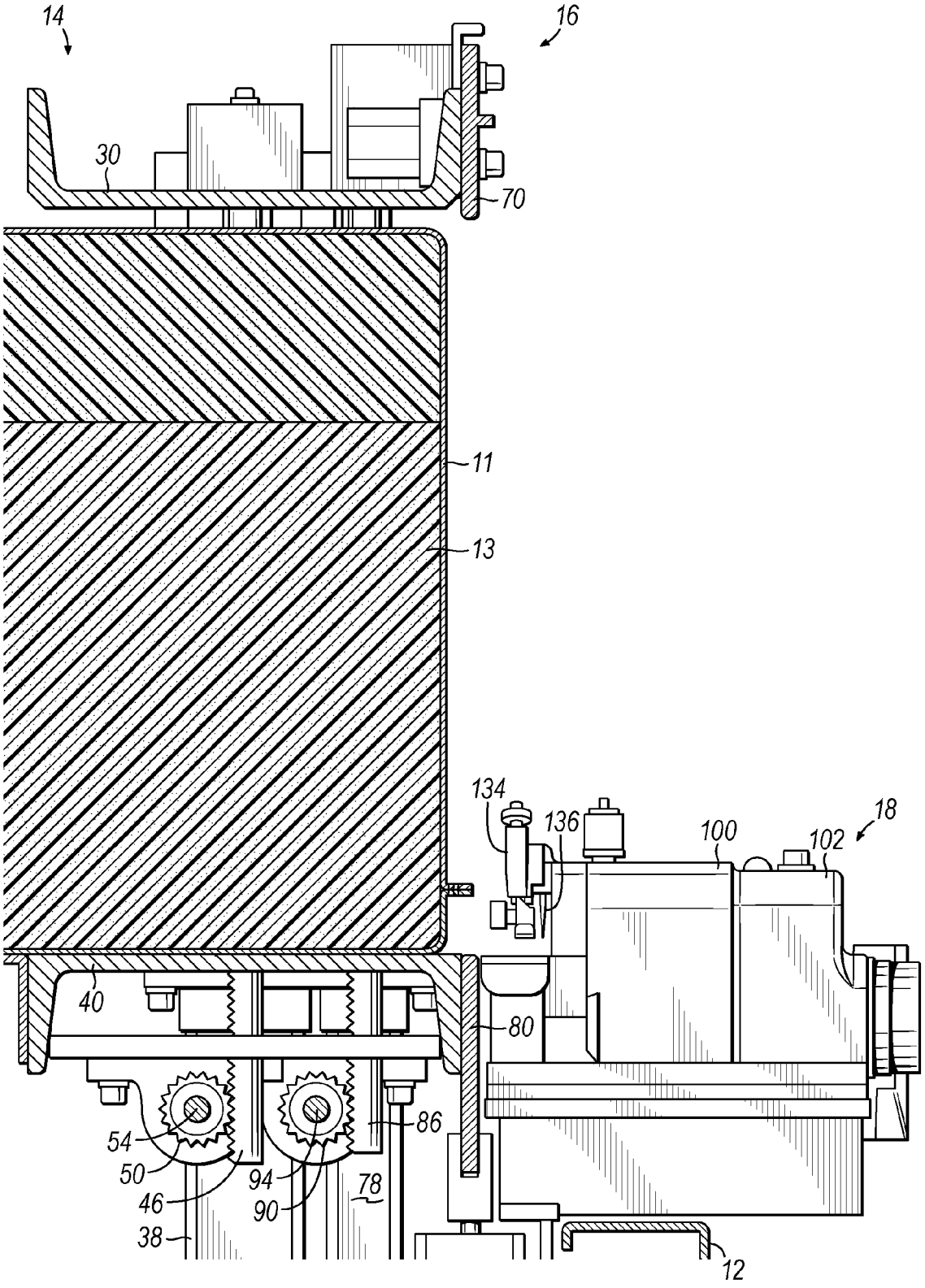
FIG. 4E is a view similar to FIG. 4D with the mattress core press and mattress cover clamp moved to the upper non-compressing non-clamping positions.

Referring to FIGS. 1-3, mattress core press assembly 14 comprises a platen 30 having a pair of opposite ends 32, 34. End 32 is operably connected to frame 12 via a pneumatic cylinder 36, and end 34 is operably connected to frame 12 via pneumatic cylinder 38. Pneumatic cylinders 36, 38 are operable to raise and lower platen 30 as will be subsequently described in more detail. Platen 30 cooperates with or otherwise acts against a press base 40 to compress the mattress core 13 therebetween, which will also be subsequently described in more detail. End 32 carries a gear rack 44, and end 34 carries a gear rack 46. Gear rack 44 meshes with a gear 48 rotatably mounted on frame 12, and gear rack 46 meshes with a gear 50 rotatably mounted on frame 12. The two gears 48, 50 are interconnected with a connecting rod 54. The gear racks 44, 46, gears 48, 50, and connecting rod 54 allow the opposite ends 32, 34 of platen 30 to travel upperwardly and downwardly in smooth synchronous movement when the platen 30 is raised and lowered.

A pair of adjustable height stop assemblies 60, 62 is mounted to the frame 12 at each end of the frame 12. Each of the height stop assemblies 60, 62 cooperates with a respective one of the ends 32, 34 of platen 30. As the assemblies 60, 62 are substantially identical, only one such assembly 62 will be described. More particularly, adjustable height stop assembly 62 comprises a pair of upright standards 64, 66 with aligned holes along their lengths and a pull pin 68 insertable through respective holes in the standards 64, 66. Pin 68 blocks further downward movement of platen 30 and thus limits the amount by which the mattress core is compressed between the upper surface of the press base 40 and the lower surface of the platen 30.

Mattress cover clamp assembly 16 comprises an upper vertically oriented plate 70 having a pair of opposite ends 72, 74. End 72 is operably connected to frame 12 via a pneumatic cylinder 76, and end 74 is operably connected to frame 12 via pneumatic cylinder 78. Pneumatic cylinders 76, 78 are operable to raise and lower upper vertically oriented plate 70 as will be subsequently described in more detail. Upper vertically oriented plate 70 cooperates with or otherwise acts against a lower vertically oriented and vertically adjustable plate 80 mounted to frame 12 to clamp the free edges of the mattress cover 13 therebetween, which will also be subsequently described in more detail. Lower vertically oriented and vertically adjustable plate 80 is operably connected to frame 12 via a pair of pneumatic cylinders 82, 82 thereby providing the vertical adjustability of plate 80. Gear rack 84 meshes with a gear 88 rotatably mounted on frame 12, and gear rack 86 meshes with a gear 90 rotatably mounted on frame 12. The two gears 88, 90 are interconnected with a connecting rod 94. The gear racks 84, 86, gears 88, 90, and connecting rod 94 allow the opposite ends 72, 74 of upper vertically oriented plate 70 to travel upperwardly and downwardly in smooth synchronous movement when the upper vertically oriented plate 70 is raised and lowered.

Sewing head assembly 18 comprises a sewing head 100 driven by a sewing head motor 102, both of which are mounted on a sewing head carriage assembly 104. One example of a suitable sewing head 100 is the Merrow M-1D high lift serger sewing head manufactured by Merrow Sewing Machine Company, Fall River, Mass. A sewing head carriage assembly motor 106 is mounted to frame 12 and has an output or driving sprocket or pulley 110 that drives a driven sprocket or pulley 112 through a chain or belt 114. Driven sprocket 112 is mounted on a drive screw 120 that is rotatably mounted to frame 12 and that extends the length of the frame 12. Drive screw 120 cooperates with one or more matingly threaded blocks 122 mounted to sewing head carriage assembly 104. Sewing head carriage assembly 104 has a rail 126 mounted thereon which cooperates with mating rail 128 that is mounted on frame 12 and that extends the length of the frame 12. Rotation of drive screw 120 by sewing head carriage assembly motor 106 thus causes sewing head carriage assembly 104 to traverse from one side of a mattress on the machine 10 to the other side of the mattress by gliding on rails 126, 128.

Sewing head 100 has a stitching assembly 134 comprised of a needle, presser foot, etc., and a blade 136. Blade 136 is operable to trim off excess cover material as sewing head 100 traverses from one side of the mattress to the other side of the mattress and as stitching assembly 134 stitches closed the open end of the cover 11.

Figure 5:
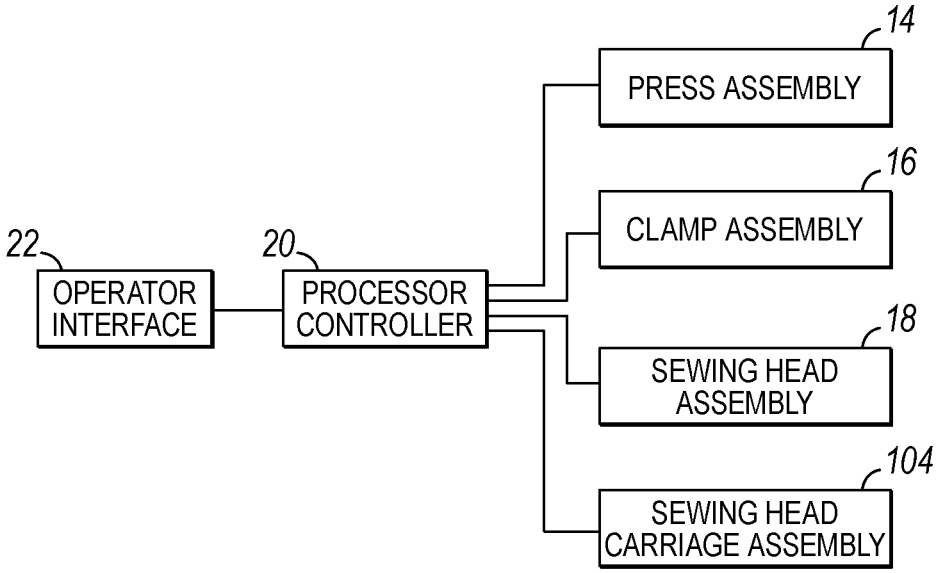
FIG. 5 is a block diagram of a control system for the machine of FIG. 1.

The processor controller 20 can be mounted in a box mounted on frame 12 and can include a computer, a processor, a microprocessor, a controller, a logic device, or any other suitable processing and controlling device configured to receive and process inputs, run software, and send outputs to control machine operations. Processor controller 20 can be configured to send and receive signals to and from the mattress core press assembly 14, the mattress cover clamp assembly 16, the sewing head assembly 18, the sewing head carriage assembly 104, and the operator interface 22. The various assemblies may have sensors associated with them that sense certain conditions and transmit signals to the processor controller 20 as a result thereof for processing by the processor controller 20. An exemplary control system for the machine 10 is shown in FIG. 5.

The operator interface 22 can be a conventional screen display with keypad, or a touch screen display, mounted on the sewing head carriage assembly 104, or any other type of operator interface, whether local to the machine 10 or remote therefrom, capable of receiving inputs from an operator and conveying information to the operator. Other acceptable forms of operator interfaces can include one or more of a conventional screen, a keypad, a keyboard, a mouse, a foot switch, etc., capable of receiving inputs from an operator and capable of conveying information to the operator such as text, graphics, audible signals, visual signals, etc. The operator interface 22 could also be on a remote electronic device, such as a computer, smartphone, or similar device remote from the machine 10.

The sewing head motor 102 and sewing head carriage assembly motor 106 are preferably variable speed, such that the cyclic rate of the stitching assembly 134 can be selected from a range of cyclic rates, and such that the linear velocity of the sewing head carriage assembly 104 can be selected from a range of velocities. As used herein, the term "speed" shall be deemed to embrace both linear velocity (of sewing head carriage assembly 104) and cyclic rate (of stitching assembly 134). Since the speed of stitching assembly 134 and the speed of sewing head carriage assembly 104 determine the number of stitches per unit length stitched into the cover material along the free edges of the cover, an operator can individually select and adjust these speeds to arrive at a desired number of stitches per unit length. To this end, processor controller 20 is preferably programmed with software that permits an operator to enter a selected sewing head motor 102 speed and a selected sewing head carriage assembly motor 106 speed that produces the desired number of stitches per unit length. The processor controller then controls the speeds of the motors 102 and 106 in accordance with these instructions entered into operator interface 22.

Referring to FIGS. 2 and 4A-4E, the operation of the machine 10 will now be described. Cover 11 is placed over core 13, and the resulting cover encased core is placed into the machine 10. The operator adjusts the pins 68, 68 to the desired height. The operator enters a command into the operator interface 22 to activate pneumatic cylinders 36, 38 to move the platen 30 downwardly to compress the core 13. The operator pulls the free edges 140, 142 of the open end of the cover 11 taught and enters a command into the operator interface 22 to activate pneumatic cylinders 76, 78 to move plate 70 downwardly to clamp the free edges 140, 142 of the open end of the cover 11 together. The operator enters a desired speed of the stitching assembly 134 into the operator interface 22 and enters a desired speed of the sewing head carriage assembly 104 into the operator interface 22, which speeds yield the desired number of stitches per unit length. The operator enters a command into the operator interface 22 to activate the sewing head motor 102 and to activate the sewing head carriage assembly motor 106. The stitching assembly 134 of the sewing head 100 stitches the free edges 140, 142 of the open end of the mattress cover 11 closed as the sewing head carriage assembly 104 traverses from one side of the mattress to the other side of the mattress. During traversal from one side of the mattress to the other side of the mattress the blade 136 trims off excess cover material. Once the open end of the cover 11 has been sewn completely closed, the operator enters commands into the operator interface 22 to activate pneumatic cylinders 36, 38 to move the platen 30 upwardly and to activate pneumatic cylinders 76, 78 to move plate 70 upwardly. The mattress can then be removed from the machine 10. The operator can enter a command into the operator interface 22 to activate the sewing head carriage assembly motor 106 to return the sewing head assembly 18 to the start position.

Note that the steps of operating the machine 10 do not necessarily have to be performed in the order described.

The various embodiments of the invention shown and described are merely for illustrative purposes only, as the drawings and the description are not intended to restrict or limit in any way the scope of the claims. Those skilled in the art will appreciate various changes, modifications, and improvements which can be made to the invention without departing from the spirit or scope thereof. The invention in its broader aspects is therefore not limited to the specific details and representative apparatus and methods shown and described. Departures may therefore be made from such details without departing from the spirit or scope of the general inventive concept. The invention resides in each individual feature described herein, alone, and in all combinations of any and all of those features. Accordingly, the scope of the invention shall be limited only by the following claims and their equivalents.

What is claimed is:

1. A machine for closing an open end of a cover encasing a mattress core in order to form a mattress, said machine comprising:

a frame adapted to support at least an edge portion of the mattress core encased in the cover, a mattress core press mounted on said frame for vertical movement, said mattress core press adapted to compress an edge of the mattress core to a desired height, a mattress cover clamp mounted on said frame for vertical movement, said mattress cover clamp adapted to clamp free edges of the open end of the mattress cover together, and a sewing head carriage, a sewing head mounted on said carriage, and a sewing head motor mounted on said carriage for driving said sewing head, said sewing head carriage mounted on said frame for horizontal movement, said sewing head adapted to stitch the free edges of the open end of the mattress cover closed as said sewing head carriage traverses from one side of the mattress to the other side of the mattress, further comprising a sewing head carriage motor mounted on said frame for driving said carriage from one side of the mattress to the other side of the mattress, wherein a speed of said sewing head motor and a speed of said sewing head carriage motor can each be selected from a range of speeds in order to produce a desired number of stitches per unit length of said machine, further comprising a processor controller operably associated with said sewing head motor and said sewing head carriage motor, and an operator interface operably associated with said processor controller, said processor controller and said operator interface configured such that an operator can enter a selected speed for each of said sewing head motor and said sewing head carriage motor via said operator interface and said processor controller will operate said sewing head motor and said sewing head carriage motor at the selected speeds.

2. A machine for closing an open end of a cover encasing a mattress core in order to form a mattress, said machine comprising:

a frame adapted to support at least an edge portion of the mattress core encased in the cover, a mattress core press mounted on said frame for vertical movement, said mattress core press adapted to compress an edge of the mattress core to a desired height, a mattress cover clamp mounted on said frame for vertical movement, said mattress cover clamp adapted to clamp free edges of the open end of the mattress cover together, and a sewing head carriage, a sewing head mounted on said carriage, and a sewing head motor mounted on said carriage for driving said sewing head, said sewing head carriage mounted on said frame for horizontal movement, said sewing head adapted to stitch the free edges of the open end of the mattress cover closed as said sewing head carriage traverses from one side of the mattress to the other side of the mattress, wherein said mattress core press comprises a platen having a pair of opposite ends, each said end operably connected to said frame by a pneumatic cylinder, said platen cooperating with a press base mounted on said frame.

3. The machine of claim 2 wherein each said end of said platen carries a gear rack, each said gear rack meshing with a respective gear rotatably mounted on said frame, said two gears interconnected with a connecting rod, whereby when said platen is raised and lowered said opposite ends of said platen travel upperwardly and downwardly in synchronous movement.

4. The machine of claim 2 wherein said frame has a pair of adjustable height stops mounted thereto each of which is configured to cooperate with a respective said end of said platen, whereby a height from an upper surface of said press base to a lower surface of said platen is selectable from a range of heights.

5. A machine for closing an open end of a cover encasing a mattress core in order to form a mattress, said machine comprising:

a frame adapted to support at least an edge portion of the mattress core encased in the cover, a mattress core press mounted on said frame for vertical movement, said mattress core press adapted to compress an edge of the mattress core to a desired height, a mattress cover clamp mounted on said frame for vertical movement, said mattress cover clamp adapted to clamp free edges of the open end of the mattress cover together, and a sewing head carriage, a sewing head mounted on said carriage, and a sewing head motor mounted on said carriage for driving said sewing head, said sewing head carriage mounted on said frame for horizontal movement, said sewing head adapted to stitch the free edges of the open end of the mattress cover closed as said sewing head carriage traverses from one side of the mattress to the other side of the mattress, wherein said mattress cover clamp comprises an upper vertically oriented plate having a pair of opposite ends, each said end operably connected to said frame by a pneumatic cylinder, said upper vertically oriented plate cooperating with a lower vertically oriented plate mounted on said frame.

6. The machine of claim 5 wherein each said end of said upper vertically oriented plate carries a gear rack, each said gear rack meshing with a respective gear rotatably mounted on said frame, said two gears interconnected with a connecting rod, whereby when said upper vertically oriented plate is raised and lowered said opposite ends of said upper vertically oriented plate travel upperwardly and downwardly in synchronous movement.

7. The machine of claim 1 wherein said sewing head has a blade mounted thereto adapted to trim off excess cover material as said sewing head carriage traverses from one side of the mattress to the other side of the mattress.

8. A machine for closing an open end of a cover encasing a mattress core in order to form a mattress, said machine comprising:

a frame adapted to support at least an edge portion of the mattress core encased in the cover, a mattress core press mounted on said frame for vertical movement, said mattress core press adapted to compress an edge of the mattress core to a desired height, a mattress cover clamp mounted on said frame for vertical movement, said mattress cover clamp adapted to clamp free edges of the open end of the mattress cover together, and a sewing head carriage, a sewing head mounted on said carriage, and a sewing head motor mounted on said carriage for driving said sewing head, said sewing head carriage mounted on said frame for horizontal movement, said sewing head adapted to stitch the free edges of the open end of the mattress cover closed as said sewing head carriage traverses from one side of the mattress to the other side of the mattress, further comprising a sewing head carriage motor mounted on said frame for driving said carriage from one side of the mattress to the other side of the mattress, wherein said sewing head carriage motor is operably connected to an elongated screw rotatably mounted on said frame, said elongated screw cooperating with a threaded block mounted on said sewing head carriage, whereby rotation of said screw by said sewing head carriage motor drives said sewing head carriage from one side of the mattress to the other side of the mattress.

9. A method of closing an open end of a cover encasing a mattress core in order to form a mattress, said method comprising:

compressing an edge of the mattress core to a desired height with a mattress core press, clamping free edges of the open end of the mattress cover together with a mattress cover clamp, and stitching the free edges of the open end of the mattress cover closed with a sewing head mounted on a sewing head carriage that traverses from one side of the mattress to the other side of the mattress, wherein the sewing head has a sewing head motor for driving the sewing head and the sewing head carriage has a sewing head carriage motor for driving the sewing head carriage, the method further comprising:

selecting a speed of the sewing head motor from a range of speeds, and selecting a speed of the sewing head carriage motor from a range of speeds, such that the selected speeds produce a desired number of stitches per unit length.

10. The method of claim 9 wherein the steps of selecting the speed of the sewing head motor and the speed of the sewing head carriage motor are accomplished by entering the selected speeds into an operator interface operably associated with a processor controller, the processor controller operably associated with the sewing head motor and the sewing head carriage motor and configured to operate the sewing head motor and sewing head carriage motor at the selected speeds.

11. The method of claim 10 wherein the processor controller is also operably associated with the mattress core press and the mattress cover clamp, and wherein the compressing and clamping steps are accomplished by entering commands into the operator interface.

12. A method of closing an open end of a cover encasing a mattress core in order to form a mattress, said method comprising:

compressing an edge of the mattress core to a desired height with a mattress core press, clamping free edges of the open end of the mattress cover together with a mattress cover clamp, selecting a desired number of stitches per unit length by which to stitch closed the open end of the cover, selecting a sewing head stitching speed at which to stitch closed the open end of the cover, selecting a sewing head travel speed by which to traverse from one side of the mattress to the other side of the mattress, the sewing head stitching speed and the sewing head travel speed cooperating to produce the selected number of stitches per unit length, and activating the sewing head to stitch closed the open end of the cover and to traverse from one side of the mattress to the other side of the mattress.

13. The method of claim 12 wherein the steps of selecting the sewing head stitching speed and the sewing head travel speed are accomplished by entering the selected speeds into an operator interface operably associated with a processor controller, the processor controller operably associated with the sewing head and configured to operate the sewing head at the selected speeds.

14. The method of claim 13 wherein the processor controller is also operably associated with the mattress core press and the mattress cover clamp, and wherein the compressing and clamping steps are accomplished by entering commands into the operator interface.

15. A machine for closing an open end of a cover encasing a mattress core in order to form a mattress, said machine comprising:

a frame adapted to support at least an edge portion of the mattress core encased in the cover, a sewing head carriage movably mounted on said frame, a sewing head carriage motor mounted on said frame for driving said carriage from one side of the mattress to the other side of the mattress, a sewing head mounted on said carriage, a sewing head motor mounted on said carriage for driving said sewing head, said sewing head adapted to stitch free edges of an open end of the mattress cover closed as said sewing head carriage traverses from one side of the mattress to the other side of the mattress, a processor controller operably associated with said sewing head motor and said sewing head carriage motor, and an operator interface operably associated with said processor controller, said processor controller and said operator interface configured such that an operator can enter a selected speed for each of said sewing head motor and said sewing head carriage motor via said operator interface and said processor controller will operate said sewing head motor and said sewing head carriage motor at the selected speeds.

16. The machine of claim 15 further comprising:

a mattress core press mounted on said frame for vertical movement, said mattress core press adapted to compress the edge of the mattress core to a desired height, and a mattress cover clamp mounted on said frame for vertical movement, said mattress cover clamp adapted to clamp the free edges of the open end of the mattress cover together, said processor controller and said operator interface further configured such that an operator can activate and deactivate said mattress core press and said mattress cover clamp by entering commands into said operator interface.

* * * * *